US011125152B2

(12) United States Patent
Karoliussen

(10) Patent No.: US 11,125,152 B2
(45) Date of Patent: Sep. 21, 2021

(54) INTERNAL COMBUSTION ENGINE

(71) Applicant: Patentec AS, Arendal (NO)

(72) Inventor: Hilberg Inge Karoliussen, His (NO)

(73) Assignee: Patentec AS, Arendal (NO)

( * ) Notice: Subject to any disclaimer, the term of this patent is extended or adjusted under 35 U.S.C. 154(b) by 0 days.

(21) Appl. No.: 16/963,468

(22) PCT Filed: Dec. 20, 2018

(86) PCT No.: PCT/EP2018/086354

§ 371 (c)(1),
(2) Date: Jul. 20, 2020

(87) PCT Pub. No.: WO2019/145105

PCT Pub. Date: Aug. 1, 2019

(65) Prior Publication Data

US 2021/0140365 A1 May 13, 2021

(30) Foreign Application Priority Data

Jan. 26, 2018 (EP) ..... 18153629

(51) Int. Cl.

| | |
|---|---|
| ***F02B 75/24*** | (2006.01) |
| ***F01B 9/02*** | (2006.01) |
| ***F01L 9/20*** | (2021.01) |
| ***F01L 1/047*** | (2006.01) |
| ***F01L 9/10*** | (2021.01) |
| ***F01L 3/02*** | (2006.01) |

(52) U.S. Cl.

CPC ..... *F02B 75/243* (2013.01); *F01B 9/023* (2013.01); *F01L 1/047* (2013.01); *F01L 3/02* (2013.01); *F01L 9/10* (2021.01); *F01L 9/20* (2021.01)

(58) Field of Classification Search

CPC ... F01L 9/20; F01L 9/10; F02B 75/243; F01B 9/023

See application file for complete search history.

(56) References Cited

U.S. PATENT DOCUMENTS 1,336,668 A 4/1920 Wigelius et al.
2,217,912 A 10/1940 Lindsey
(Continued)

FOREIGN PATENT DOCUMENTS

EP 1170482 1/2002
WO 9513463 5/1995
(Continued)

OTHER PUBLICATIONS

Patent Cooperation Treaty, "International Search Report and Written Opinion," issued in connection with PCT Patent Application No. PCT/EP2018/086354, dated Mar. 29, 2019, 9 pages.
(Continued)

*Primary Examiner* — Kevin A Lathers
(74) *Attorney, Agent, or Firm* — Hanley, Flight & Zimmerman, LLC

(57) ABSTRACT

It is disclosed a boxer engine with two substantially mirror-symmetric engine sides (L, R) comprising a crankshaft (1) to which is connected, at least two main scotch yoke assemblies (110) each having one main piston (7) arranged inside one main cylinder (I, III; II, IV) of each engine side (R; L), and at least one auxiliary scotch yoke assembly (120) having a pair of auxiliary pistons (8) arranged inside a pair of auxiliary cylinders (V, VII; VI, VIII) of each engine side (R; L), wherein the main scotch yoke assemblies (110) are arranged synchronized on the crankshaft (1) and the at least one auxiliary scotch yoke assembly (120) is arranged 180° offset on the crankshaft (1), each auxiliary piston (7) defining an outer space and an inner space within each auxiliary cylinder (V, VII; VI, VIII), the inner space facing the opposite engine side (R; L), wherein, (Continued)

said inner spaces of each auxiliary cylinder (V, VII; VI, VIII) pair are in fluid communication and forming a compression chamber, said compression chamber comprises first and second check valves (69, 70), wherein the auxiliary cylinder (V, VII; VI, VIII) pair is adapted to suck in ambient air through the first check valve (69) and compress and pump said air out through the second check valve (70) into a main cylinder (I, III; II, IV) of the opposite engine side (R; L), and said outer spaces of each auxiliary cylinder (V, VII; VI, VIII) pair are in fluid communication and are receiving pressurized exhaust gas from a main cylinder (I, III; II, IV) of the same engine side (R; L).

12 Claims, 10 Drawing Sheets

(56) References Cited

U.S. PATENT DOCUMENTS 6,397,579 B1 * 6/2002 Negre ..... F02B 41/06 60/39.6
2012/0272758 A1 11/2012 Diggs
2013/0098335 A1 * 4/2013 Diggs ..... F01B 7/16 123/45 R
2014/0318518 A1 * 10/2014 Jeswine ..... F01B 9/023 123/73 R

FOREIGN PATENT DOCUMENTS

WO 2004076833 9/2004
WO 2014145445 9/2014

OTHER PUBLICATIONS

European Patent Office, Extended European Search Report, issued in connection with European Patent Application No. 18153629.3 dated Jul. 27, 2018, 5 pages.
International Searching Authority, International Preliminary Report on Patentability, issued in connection with PCT Patent Application No. PCT/EP2018/086354, dated Jul. 28, 2020, 6 pages.
European Patent Office, Intention to Grant, issued in connection with European Patent Application No. 18153629.3 dated Feb. 24, 2020, 5 pages.
European Patent Office, Decision to Grant, issued in connection with European Patent Application No. 18153629.3 dated Jun. 25, 2020, 2 pages.

* cited by examiner

INTERNAL COMBUSTION ENGINE

CROSS-REFERENCE TO RELATED APPLICATIONS

This patent is a U.S. national stage application of International Patent Application No. PCT/EP2018/086354 which was filed on Dec. 20, 2018 under the Patent Cooperation Treaty (PCT), which claims priority to European Patent Application No. 18153629.3 which was filed on Jan. 26, 2018, all of the foregoing applications are hereby incorporated herein by reference in their entireties.

TECHNICAL FIELD

The present invention relates generally to an internal combustion engine, in particular an internal combustion engine with low emission, for use in automobiles.

BACKGROUND

Ever since the internal combustion engine was first introduced centuries ago, it has continuously been developed and modified in order to adapt to the ever-changing demands in the market. Recent trends are increasingly concerned with environmental aspects and a sustainable future, calling for engines with lower emissions, which at this point can only be achieved by lowering the fuel consumption. Some of the concepts that have been introduced, with the intention of lowering the fuel consumption, are split cycle processes, variable valve timing and variable compression ratio.

A split cycle process occurs when the compression or expansion, or both, takes place in two or several stages. In theory, this concept should provide increased efficiency, but verification testing has shown increased mechanical and thermal losses, yielding insufficient payback for its complexity, additional weight and increased production cost.

In spark ignited engines, with a constant compression ratio, which use suction throttles for controlling the output power, a reduction of the filling ratio will cause a reduced pressure at the end of a compression stroke. Hence, the efficiency factor will decrease as the filling ratio decreases. To maintain a stable efficiency factor, thus increasing its overall efficiency, the compression ratio must be adjusted according to the filling ratio. Variable compression engines allow for the volume above the piston at top dead centre (TDC) to be changed. For automotive use, this needs to be done dynamically in response to the load and driving demands, as higher loads require lower ratios to be more efficient and vice versa. However, also this concept requires complex and heavy mechanisms, causing high production costs. This concept has also faced issues with vibrations. An example of prior art is disclosed by EP1170482.

Variable valve timing, also known as variable valve lift (used by Nissan) or "variable onckenwellen steuerung" (used by BMW, Ford, Ferrari and Lamborghini), makes it possible to adjust the opening times (lift, duration or both) for the suction or exhaust side valves whilst the engine is in operation. Variable valve timing can provide the benefits of internal exhaust gas recirculation, increased torque and better fuel economy, but production is expensive.

Another concept with beneficial features is the scotch yoke principle. Some of the features are exact sinusoidal reciprocating parts, fully dynamic mass balance which makes it vibration free, and options for simple double acting piston arrangements. Scotch yoke mechanisms are widely used in piston pumps, valve actuators, sewing machines and engines, as seen in US2012272758.

SUMMARY OF THE INVENTION

The present invention has the objective of providing an internal combustion engine incorporating the above-mentioned concepts, which solves the identified disadvantages in order to reduce the emission.

Said objectives are fully or partially achieved by an engine according to the independent claims. Preferred embodiments are set forth in the dependent claims.

According to a first aspect, the invention relates to a boxer engine with two substantially mirror-symmetric engine sides comprising a crankshaft to which is connected, at least two main scotch yoke assemblies each having one main piston arranged inside one main cylinder of each engine side, and at least one auxiliary scotch yoke assembly having a pair of auxiliary pistons arranged inside a pair of auxiliary cylinders of each engine side, wherein the main scotch yoke assemblies are arranged synchronized on the crankshaft and the at least one auxiliary scotch yoke assembly is arranged 180° offset on the crankshaft, each auxiliary piston defining an outer space and an inner space within each auxiliary cylinder, the inner space facing the opposite engine side, wherein, said inner spaces of each auxiliary cylinder pair are in fluid communication and forming a compression chamber, said compression chamber comprises first and second check valves, wherein the auxiliary cylinder pair is adapted to suck in ambient air through the first check valve and compress and pump said air out through the second check valve into a main cylinder of the opposite engine side, and said outer spaces of each auxiliary cylinder pair are in fluid communication and are receiving pressurized exhaust gas from a main cylinder of the same engine side.

The advantage of such an engine is that it enables two split cycle processes to take place, i.e. a compression process and an expansion process. For the expansion process, rather than discharging the remaining pressure within a main cylinder after a complete expansion stroke, the remaining pressure in all main cylinders are transferred to an outer space of a corresponding auxiliary cylinder pair so it can be used to further power the crankshaft and/or the compression process; thus, increasing the efficiency factor of the engine which in turn contributes to reduced emissions. For the compression process, rather than starting a compression stroke with a main cylinder filled with air at atmospheric pressure, a compression stroke starts with a main cylinder filled with compressed air; thus, reducing the fuel consumption and emissions.

Another advantage of such an engine is that the linear motion of the reciprocating scotch yoke assembly contributes to reduce vibrations in the engine. The scotch yoke also makes the pistons centric stable.

According to an embodiment of the present invention, the auxiliary pistons comprise circumferentially arranged pressure trap grooves. Since the pistons are centric stable, replacing pistons rings with pressure trap grooves will significantly reduce the friction between the auxiliary pistons and the auxiliary cylinder liners. This friction reduction is an improvement with regard to mechanical loss.

According to a second aspect, the present invention relates to a boxer engine wherein each main scotch yoke assembly comprises a main piston rod with a polygonal cross-section for each engine side, wherein each main piston rod: at a first end has a swivel connection to the corresponding main piston; at a second end has a threaded connection to a stud projecting from a corresponding main yoke; and is embraced by a longitudinally sliding worm gear.

With this mechanism, it is achieved a robust and accurate adjustment of the compression ratio of the main cylinders, whilst at the same time having an uncomplicated design, which is an improvement with regards to weight and production cost.

According to an embodiment of the present invention, worm control shafts engage the worm gears of the same engine side, said worm control shafts being adjusted by means of hydraulic or electric actuators. In this way, the compression ratio of two main cylinders are simultaneously operated by one control shaft, which increases its precision, and by incorporating hydraulic or electric actuators, the precision is further increased.

According to a third aspect, the invention relates to a boxer engine comprising two connecting shafts connecting the crankshaft and the camshafts operating the suction valves and the discharge valves of the main cylinders and the exhaust valves of the auxiliary cylinders, wherein each connecting shaft: at a first end portion comprises first internal helical splines engaged with first external helical splines of a first protruding spindle of a first connecting shaft bevel gear, said first connecting shaft bevel gear being engaged with a cam shaft bevel gear connected to the camshaft; at a second end portion comprises second internal helical splines engaged with second external helical splines of a second protruding spindle of a second connecting shaft bevel gear, said second connecting shaft bevel gear being engaged with a crankshaft gear connected to the crankshaft; and has a length which allows some longitudinal movement of the connecting shaft along the first and second protruding spindles, wherein the first external helical splines and the second external helical splines are opposite threaded, and the first internal helical splines and the second internal helical splines are opposite threaded.

With this mechanism, it is achieved a robust and accurate adjustment of the valve timing, whilst at the same time having an uncomplicated design, which is an improvement with regard to weight and production cost.

According to an embodiment of the present invention, the connecting shafts are longitudinally adjusted simultaneously by means of hydraulic or electric actuators. In this way, the precision is increased.

According to another embodiment of the present invention, the boxer engine comprises a cam shaft with a double cam in a middle region. The double cam enables one camshaft to operate both the auxiliary cylinder pair and the two main cylinders of the same engine side, ref. table 1.

The main cylinders and the outer spaces of an auxiliary cylinder pair of the same engine side are preferably connected by a valve seat plate to facilitate the split cycle expansion process.

The compression chambers and the main cylinders are preferably connected by at least one connecting channel to facilitate the split cycle compression process. By making the connecting channel air cooled, the charge of air supplied to the main cylinders will be further compressed, which will reduce the fuel consumption and emissions.

Balancing the weight of the at least one auxiliary yoke assembly with the weight of the at least two main yokes assemblies will reduce vibrations in the engine, which will enhance its durability and performance.

A cylinder bottom plate sealing around the reciprocating auxiliary piston rod makes the compression chamber substantially air tight, which enables the split cycle compression process.

BRIEF DESCRIPTION OF FIGURES

The invention will now be described with reference to the exemplifying embodiments shown in the accompanying drawings, wherein.

DETAILED DESCRIPTION

Figure 1:
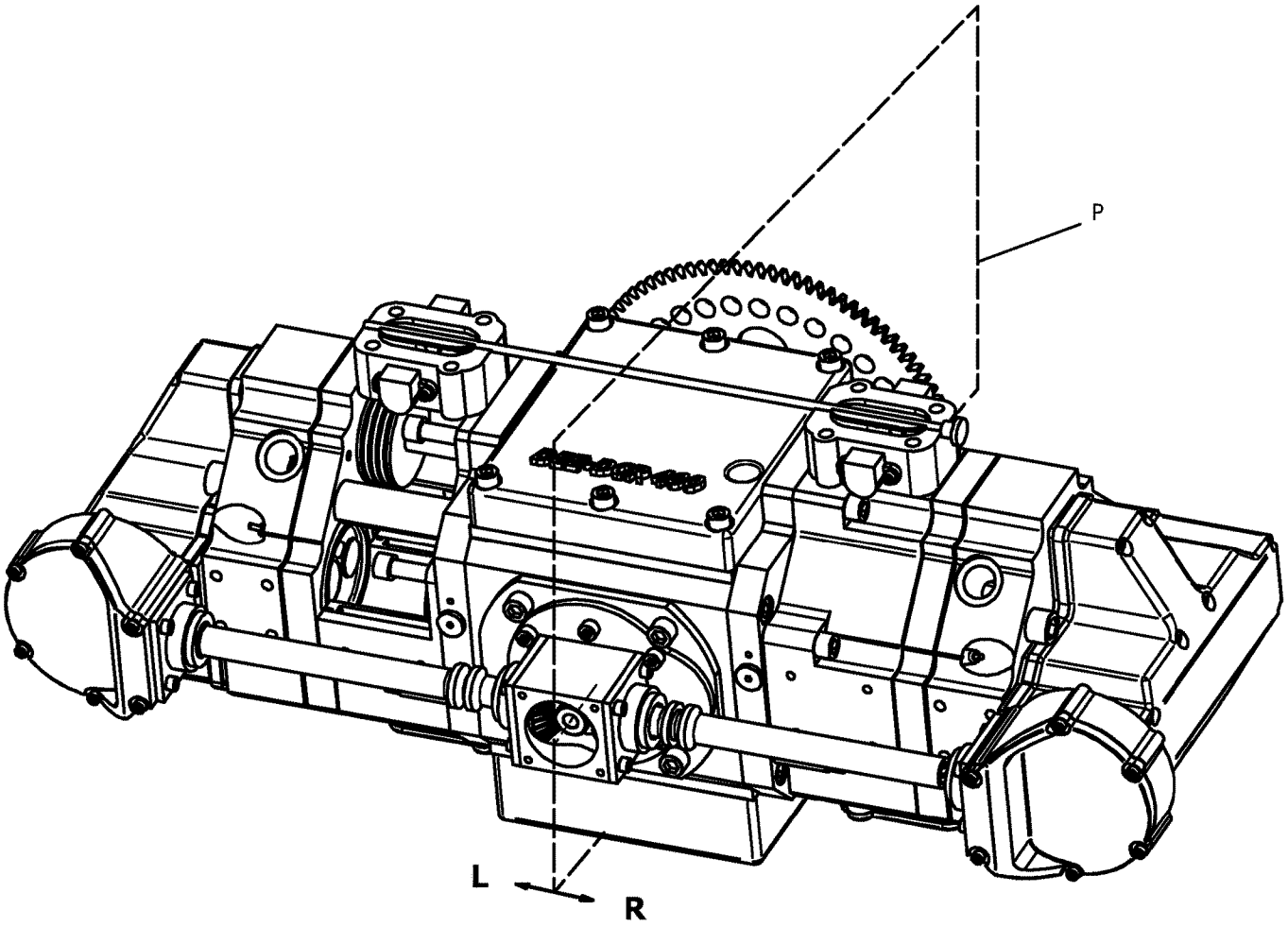
FIG. 1 shows an isometric view of the engine assembled.

In the disclosed figures, there are illustrated a boxer type internal combustion engine. FIG. 1 shows an isometric view of the assembled engine. The engine is divided into two engine sides R, L. which are defined by a plane P of symmetry, wherein the two engine sides R, L substantially are mirror images of each other. The engine of the present invention could be used as a mono side design. A mono side design would need an accumulator for the first stage compressed charge, and because of pulsation in this it would perform with a lower efficiency. Hence, the dual side design is preferred.

Scotch Yoke Mechanism

Figure 2:
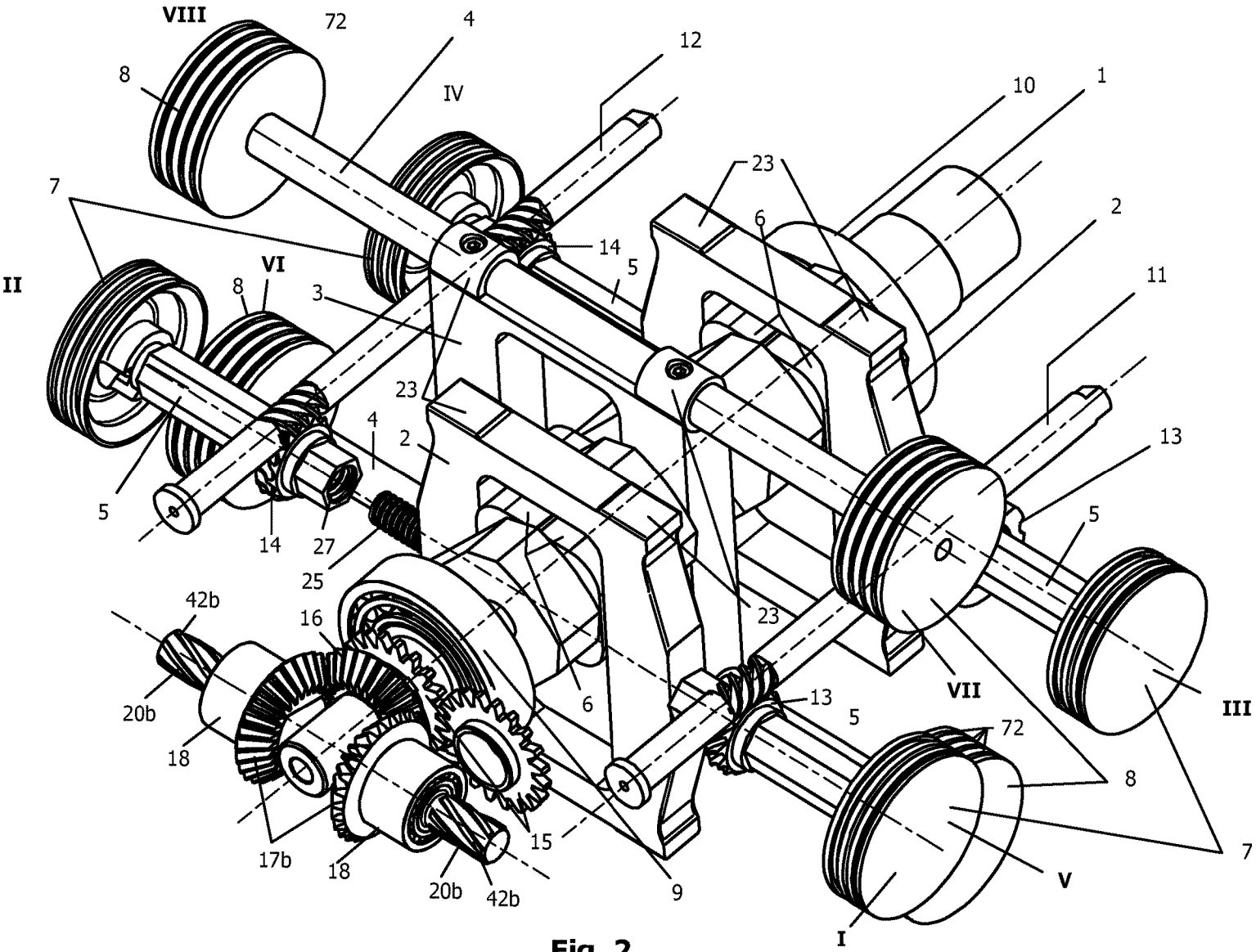
FIG. 2 shows a detail of the engine.
Figure 4:
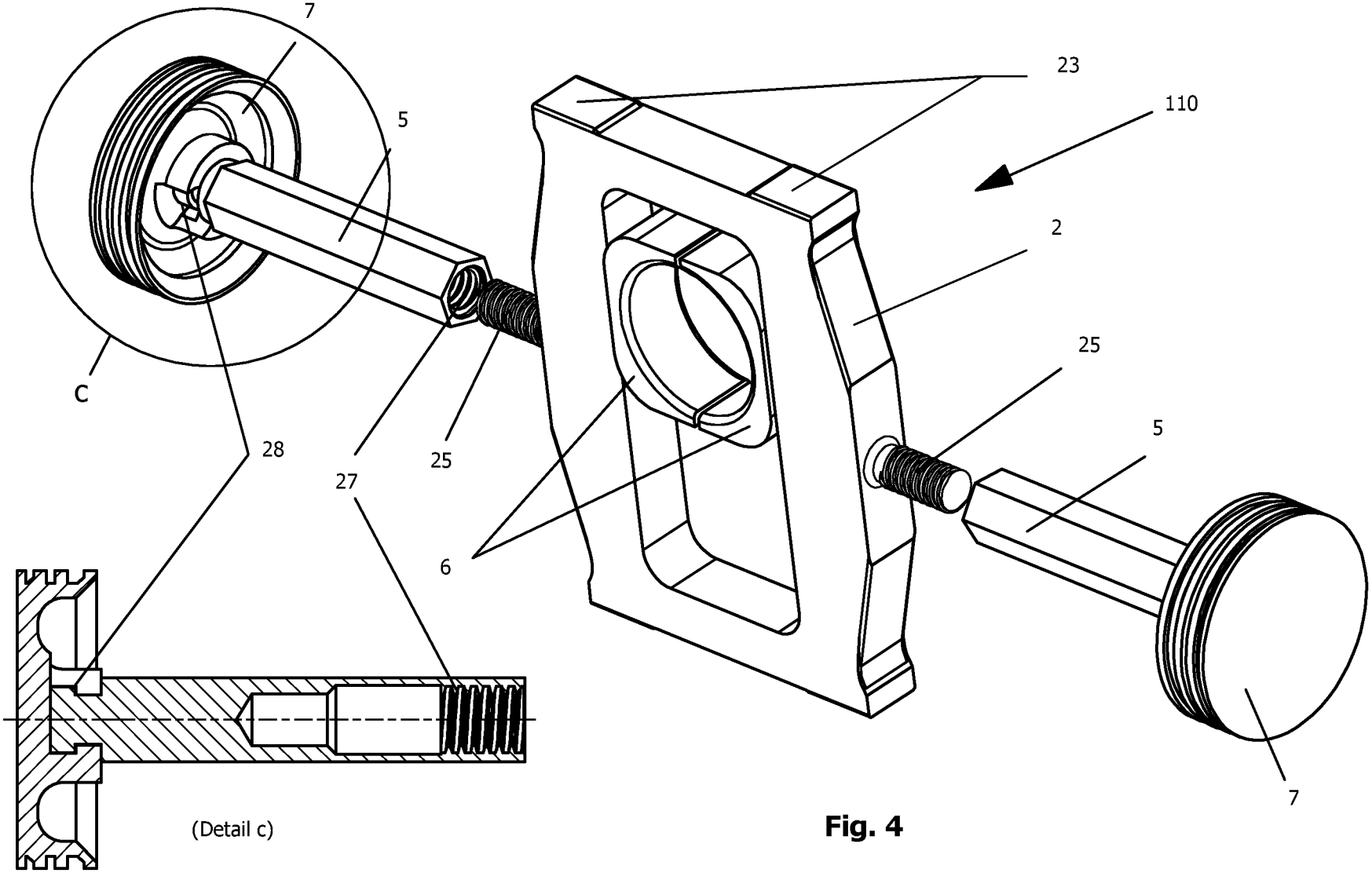
FIG. 4 shows a scotch yoke.
Figure 5:
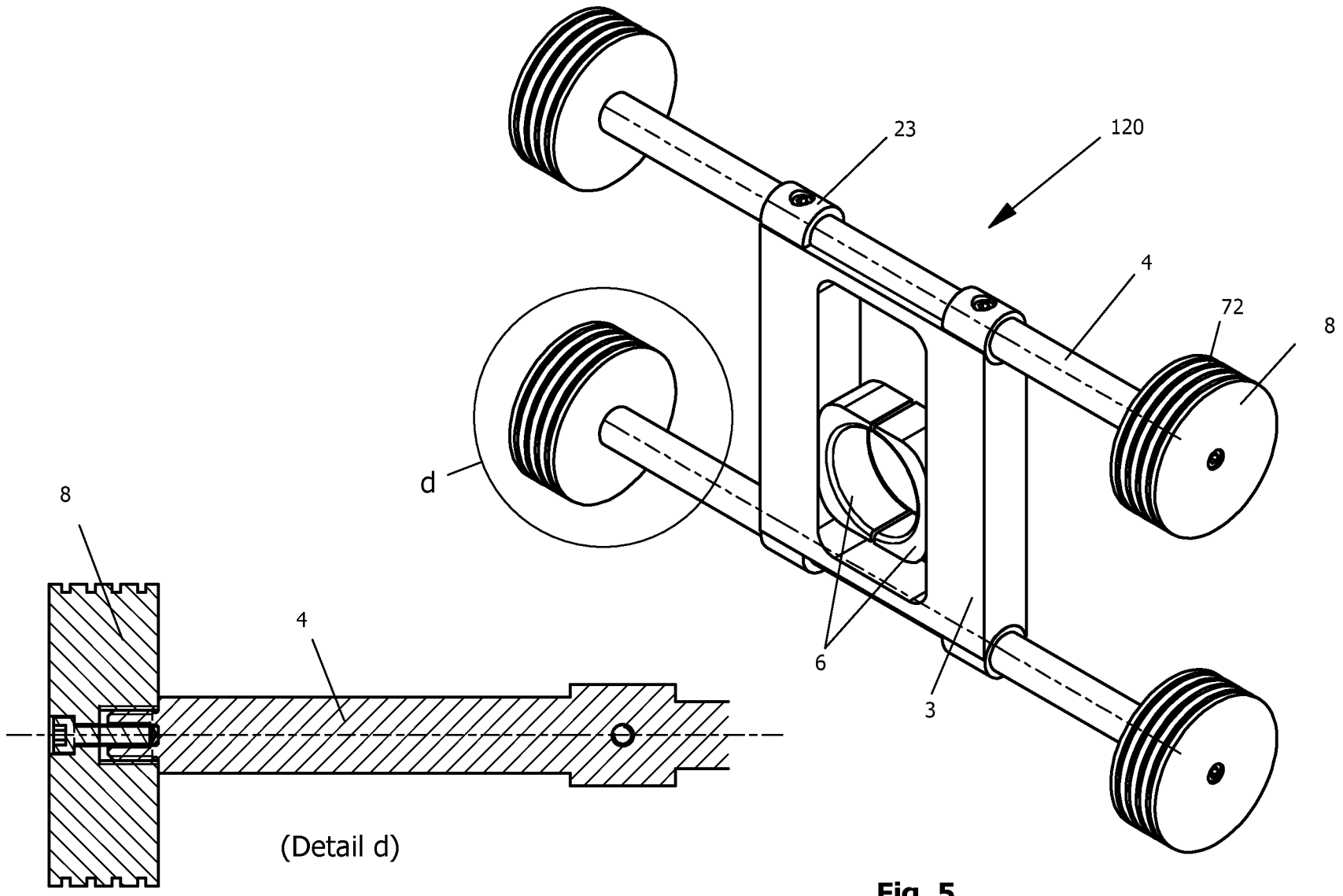
FIG. 5 shows a scotch yoke.

In the engine, the linear motion of the pistons 7, 8 moving inside the cylinders are converted into rotational motion of the crankshaft 1, by the scotch yoke assemblies 110, 120. As detailed in FIG. 4 and FIG. 5, the engine has two types of scotch yoke assemblies 110, 120, respectively a main scotch yoke assembly 110 and an auxiliary scotch yoke assembly 120. FIG. 2 shows a setup with a middle auxiliary scotch yoke assembly 120 and two outer main scotch yoke assemblies 110.

The main scotch yoke assemblies 110 comprise a main yoke 2, two crankshaft bearing halves 6, two studs 25, two main piston rods 5 and two main pistons 7. The main pistons 7 are connected to the main piston rods 5 with swivel couplings 28, illustrated in FIG. 4 detail b. The main piston 7 has a slot in the swivel coupling 28, permitting the main piston 7 to be assembled sideways onto the main piston rod 5. This type of coupling will allow the main piston rod 5 to rotate freely relative to the main piston 7. The main piston rod 5 has a swivel coupling 28 in a first end and internal threads 27 in a second end. The main piston rod 5 has a polygonal cross section. The studs 25 connect the main piston rods 5 to the main yoke 2. The studs 25 can be attached to the main yoke 2 by means of welded or threaded connections, alternatively they can also be machined from the same piece. The main yoke 2 is substantially rectangular with sliding surfaces 23 fully or partly covering the upper and lower surfaces. The main piston rods 5 are positioned in central areas of the two side surfaces of the main yoke 5, and are of the same length. The main yoke has a rectangular aperture in which the crankshaft bearing halves 6 are fitted. The crank shaft bearing halves 6 embrace the camshaft 1. The two crankshaft halves 6 combined are adapted to a sliding motion in the longitudinal direction of the aperture.

The auxiliary scotch yoke assembly 120 comprises an auxiliary yoke 3, two crankshaft bearing halves 6, two auxiliary piston rods 4 and four auxiliary pistons 8. The auxiliary pistons 8 are connected to the auxiliary piston rods 4 with a threaded and/or bolted connection. The auxiliary piston rods 4 are connected to the auxiliary yoke 3 with a bolted connection. The auxiliary yoke 3 is substantially rectangular, and has an aperture equal to the one of the main yoke 2. Equal crankshaft bearing halves 6 are used in the auxiliary scotch yoke assembly 120 as in the main scotch yoke assembly 110. Each auxiliary piston rod 4 has one auxiliary piston 8 connected to each of its two ends. Two auxiliary piston rods 4 are connected to the upper and lower surfaces of the auxiliary yoke 3. Both auxiliary piston rods 4 protrudes an equal distance at both sides of the auxiliary yoke 3, and both auxiliary piston rods 4 are of the same length. This means that the two auxiliary pistons 8 of a first engine side R, L will reach the top dead centre (TDC) simultaneously with the two auxiliary pistons 8 of a second engine side R, L reaching the bottom dead centre (BDC), and vice versa. Instead of piston rings, the auxiliary pistons 8 are equipped with pressure trap grooves 72.

The weight of the auxiliary scotch yoke assembly 120 is balanced equal to the combined weight of the two main scotch yoke assemblies 110. This is typically achieved by material selection, choosing materials with the desired mechanical properties, but with different density, e.g. steel and aluminium.

Figure 3:
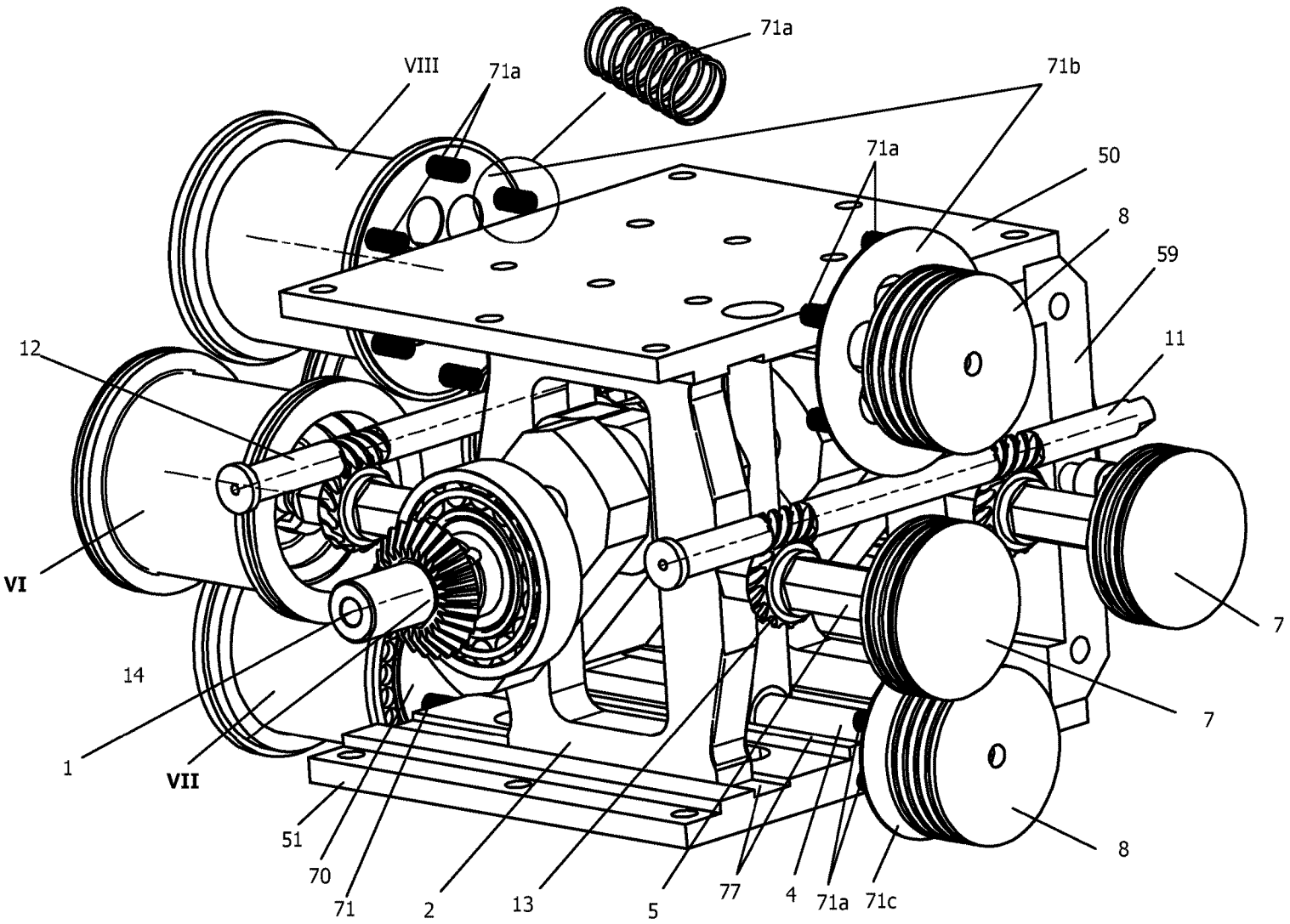
FIG. 3 shows a detail of the engine.

FIG. 3 shows the same three scotch yoke assemblies 110, 120 as FIG. 2. The scotch yoke assemblies 110, 120 are arranged in guiding grooves 77 in an upper guiding plate 50 and a lower guiding plate 51, which are mounted to a rear crankshaft bearing plate 59.

Variable Compression Ratio

FIG. 3 illustrates the mechanism enabling variable compression. By altering the top dead centre (TDC) of the main pistons 7, a relatively constant compression pressure over the whole speed and load range can be achieved, i.e. the engine compression end pressure will remain on its decided value whatever the degree of charge filling in the main cylinders I, III; II, IV is. The variable compression mechanism of the present invention utilizes worm gears 13, 14 and worm gear control shafts 11, 12 to adjust the TDC of the main pistons 7.

Worm gears 13, 14 with a central polygonal aperture, corresponding to the cross section of the main piston rods 5, are arranged on the main piston rods 5. The worm gears 13, 14 are adapted to rotate the main piston rods 5, whilst the piston rods 5 can freely slide relative to the worm gears 13, 14 in their longitudinal direction. As the worm gear 13, 14 turns, the main piston rod 5 will travel the threads of the stud 5. Since the stud 5 is static relative to the main yoke 2, the travel of the main piston rod 5 will change its distance to the main yoke 2. This will in turn change the distance between the main piston 7 and the corresponding main yoke 2. When changing the distance between the main yoke 2 and the main piston 7, the TDC of the same main piston 7 will be changed at an equal ratio.

A worm control shaft 11, 12 is arranged on each engine side R, L, and kept in place by a cylinder bottom plate 52. Each worm control shaft 11, 12 has a worm in engagement with each worm gear 13, 14 of the same engine side R, L, in this case two. The worm gears 13, 14 and the worm control shafts 11, 12 of opposite engine sides R, L are preferably made with opposite gears, e.g. the worm gears 14 of the left engine side L having left hand helical gears and the worm gears 13 of the right engine side R having right hand helical gears. In this way the TDC of the main pistons 7 on both engine sides R, L will change correspondingly when the worm control shafts 11, 12 are rotated in the same direction, e.g. by turning both worm control shafts 11, 12 clockwise, the TDC of all main pistons will be lowered. The worm control shafts 11, 12 might be driven by means of hydraulic or electric actuators. Preferably the worm gear transmission has a high reduction ratio. One of the advantages of a high reduction ratio is that it enables a fine adjustment of the top dead centre (TDC) of the main pistons 7. Another advantage of a high reduction ratio is that it eliminates the possibility of the output (worm gear 13, 14) driving the input (worm control shaft 11, 12), also known as a self-locking configuration.

Split Cycle Process

The inventive use of the know split cycle process in the present invention comprises a two-stage compression and a two-stage expansion. Said stages are split between main cylinders I, III; II, IV and auxiliary cylinders V, VII; VI, VIII. In the embodiment disclosed in the figures, the engine has four main cylinders I, III; II, IV and four auxiliary cylinders V, VII; VI, VIII. As an alternative embodiment, it would be possible to double the number of cylinders by adding them in series or in parallel.

Figure 6:
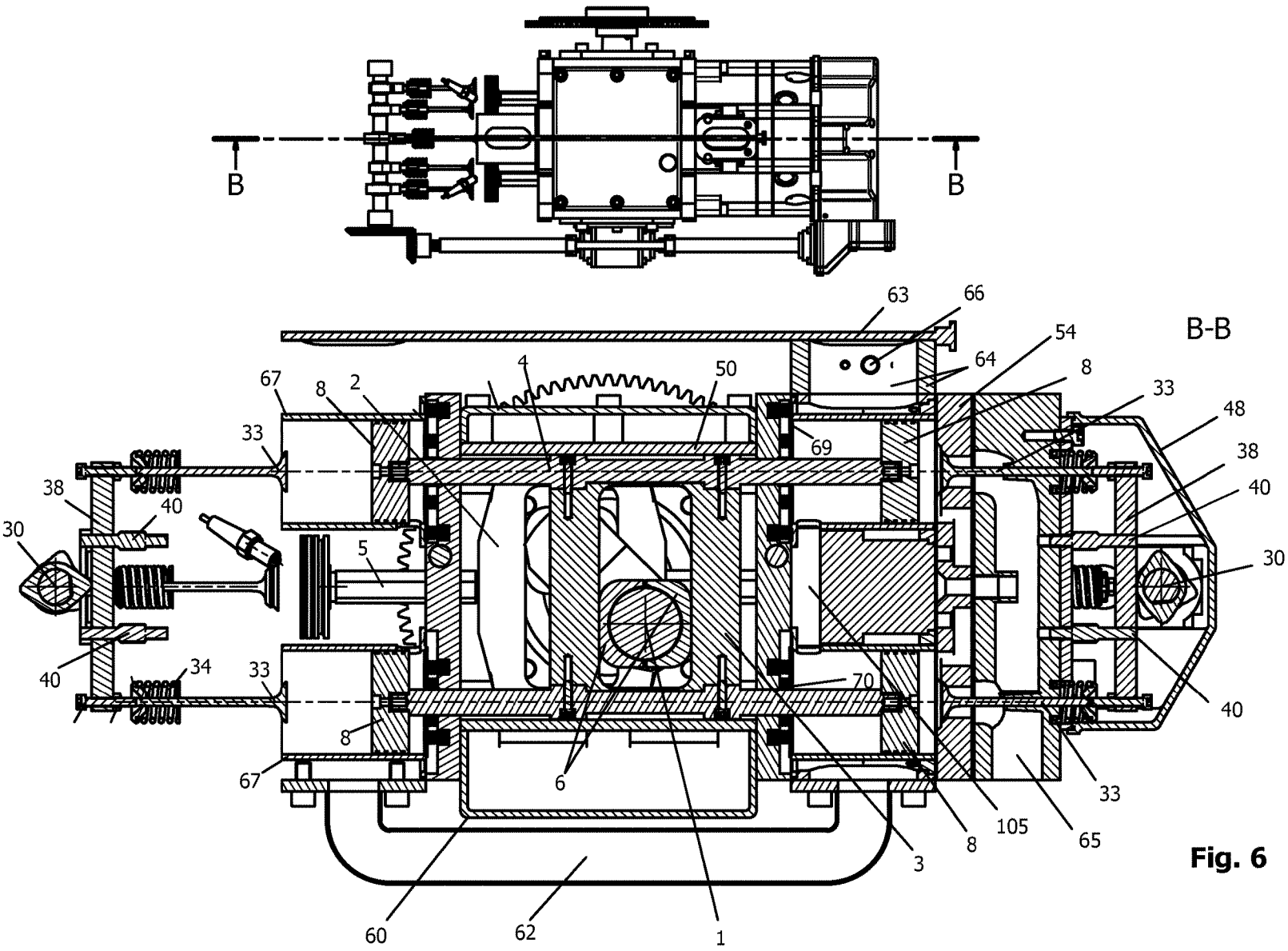
FIG. 6 shows a vertical section view of the engine.

FIG. 6 shows a vertical section view of the engine, showing the complete right engine side R, and the left engine side L with most of the static parts hidden, leaving the valve arrangement, pistons and auxiliary cylinder liners 67. The section view cuts through the centre of the auxiliary yoke 3 and the four auxiliary cylinders V, VII; VI, VIII.

Within each auxiliary cylinder V, VII; VI, VIII, the auxiliary piston 8 defines an outer space and an inner space, wherein the inner space, closest to the auxiliary yoke 3, is used for compression and the outer space is used for expansion. The pressure difference between the outer space and the inner space of the auxiliary cylinder V, VII; VI, VIII is up to approximately 6 bar at full power. The auxiliary pistons 8 are made of a material (preferably steel) with mechanical and thermal properties allowing some hot gas leakage from the outer space to the inner space without causing erosion of the auxiliary pistons 8. The auxiliary pistons 8 are therefore equipped with a number of pressure trap grooves 72 instead of piston rings. The clearance between the auxiliary piston 8 and the auxiliary cylinder liner 67 is very small. The centring of the pistons 8 is secured as their auxiliary piston rods 4 are centric stable. Fluids slipping inn between the auxiliary piston 8 and the auxiliary cylinder liner 67 will be trapped in the pressure trap grooves 72. It is also acceptable if some fluids travel from one side of the auxiliary piston 8 to the other. This design eliminates mechanical friction loss in the auxiliary cylinders 8, and they do not require lubrication.

Two auxiliary cylinders V, VII; VI, VIII of the same engine side R, L are equipped with a pair of oppositely directed check valves 69, 70. Fluids can flow into the inner space through a first check valve 69 arranged in a first auxiliary cylinder V, VII; VI, VIII. As vacuum builds up in the inner space, the first check valve 69 will open and allow fluids to enter. The first check valve 69 is an inlet into the inner space, which prevents fluids from escaping the inner space. Through a second check valve 70 arranged in a second auxiliary cylinder V, VII; VI, VIII, fluids can escape the inner space. As pressure builds up in the inner space, the second check valve 70 will open and allow fluids to escape. The second check valve 70 is an outlet from the inner space, which prevents fluids from entering the inner space. Fluid communication is provided between the inner spaces of the first and second auxiliary cylinders V, VII; VI, VIII by an interconnecting bore 105, casing or similar (also illustrated in FIG. 7). The check valves 69, 70 are positioned at the bottom of each auxiliary cylinder V, VII; VI, VIII, which is the end closest to the yoke 3. In the centre of the check valves 69, 70, an aperture is provided having a sealing interface towards the reciprocating auxiliary piston rods 4. The check valves 69, 70 can for instance comprise discs sealing the bottom of the auxiliary cylinders V, VII; VI, VIII, which discs are spring-loaded in the desired direction to a suitable preload.

This design makes the combined inner spaces of an auxiliary cylinder pair V, VII; VI, VIII of the same engine side R, L substantially sealed, which in turn enables suction of ambient air into the inner space by the auxiliary pistons 8, and it also enables compression of said ambient air by said auxiliary pistons 8. The flow of ambient air into the inner space is regulated by a throttle 63. Compressed air/fuel mixture escaping the inner space of the auxiliary cylinders V, VII; VI, VIII through the second check valve 70 is led through a connection channel 62 into an inlet manifold of the main cylinders I, III; II, IV of the opposite engine side R, L. The charge of compressed air/fuel mixture will enter a first main cylinder I, III; II, IV having an open suction valve 31, a second main cylinder I, III; II, IV will at this point have a closed suction valve 31. At full throttle, the filling ratio in a main cylinder I, III; II, IV will be up to 200%. The main cylinder I, III; II, IV receiving the charge will be at its BDC. Once the charge is received in the main cylinder I, III; II, IV, the suction valve 31 will close and the main piston 7 will compress the charge further within said main cylinder I, III; II, IV; hence, a two-stage compression. The consecutive charge delivered to said inlet manifold will be received by a second main cylinder I, III; II, IV, this time with an open suction valve 31, and the first main cylinder I, III; II, IV having a closed suction valve 31.

The main scotch yokes 110 are arranged synchronized on the crankshaft 1 and the auxiliary scotch yoke 120 is arranged 180° offset on the crankshaft 1. This means that when the main pistons 7 of an engine side R, L is at the TDC, the auxiliary pistons 8 of the same engine side R, L is at the BDC. Table 1 shows the steps taking place in all cylinders I, III; II, IV, V, VII; VI, VIII during a complete cycle.

Figure 7:
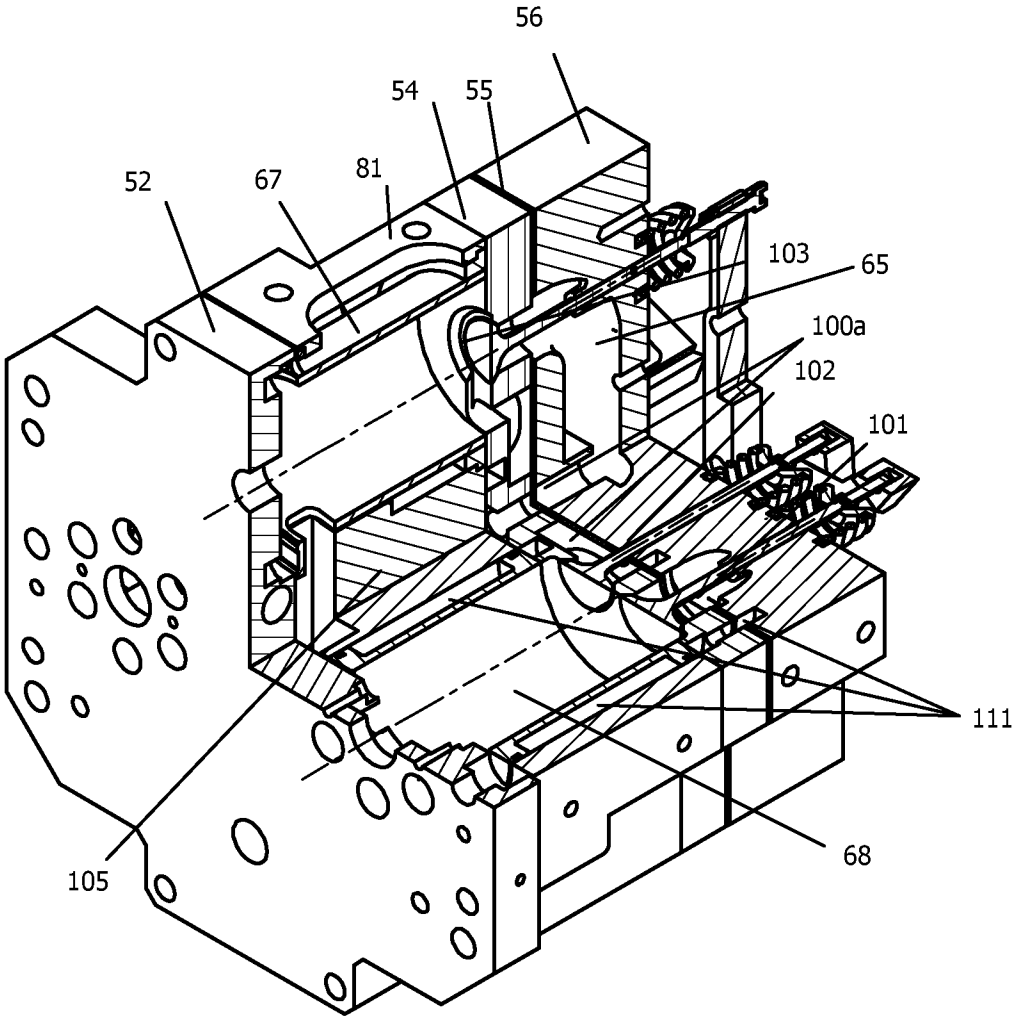
FIG. 7 shows a detail of the engine,
FIG. 8 a and b shows a detail of the engine.

FIG. 7 shows a 90° section cut of a top section of the engine. The figure illustrates a cylinder bottom plate 52, a cylinder block 81, a valve seat plate 54, a metal gasket 55 and a valve top block 56, where the section cut goes through the centre of both a main cylinder I, III; II, IV and an auxiliary cylinder V, VII; VI, VIII, both with their pistons 7, 8 and piston rods 4, 5 removed.

After the second stage of the two-stage compression has been completed in a main cylinder I, III; II, IV, the charge is ignited by a spark plug 47. An expansion then takes place in the main cylinder I, III; II, IV, like in an ordinary internal combustion engine. When the expansion has driven the main piston 7 to its BDC, there will remain some pressure in the exhaust gas inside the main cylinder I, III; II, IV. This remaining pressure is then transferred to the auxiliary cylinders V, VII; VI, VIII for a second expansion stage; hence a two-stage expansion. Said expansion takes place in a combined outer space of an auxiliary cylinder pair V, VII; VI, VIII of the same engine side R, L, driving the auxiliary pistons 8 from their TDC to their BDC.

Figure 8B:
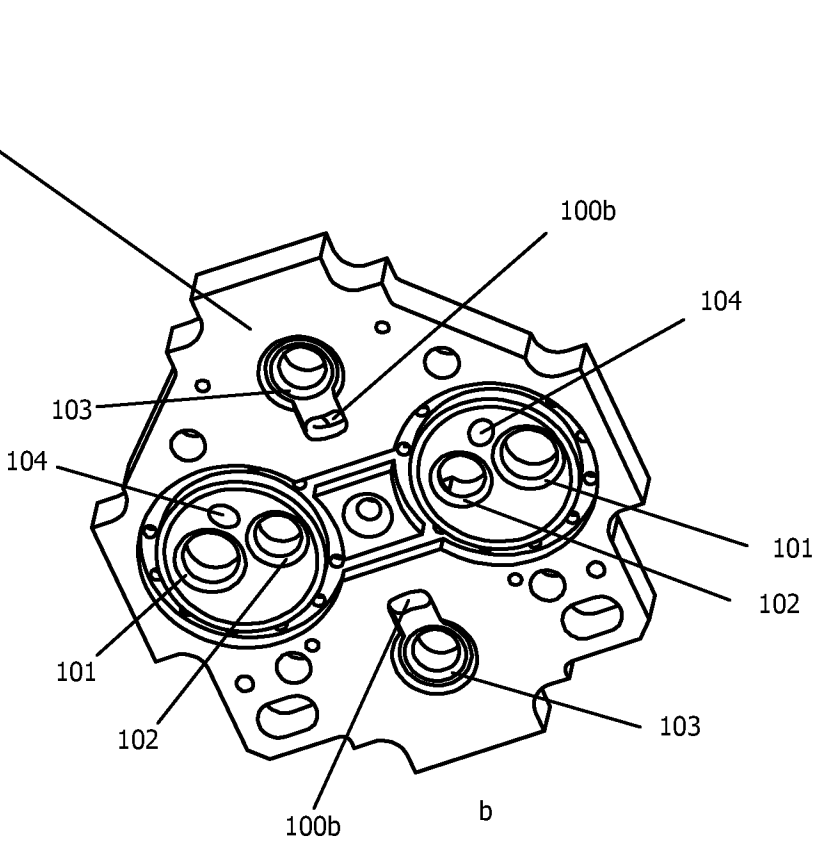
Figure 8A:
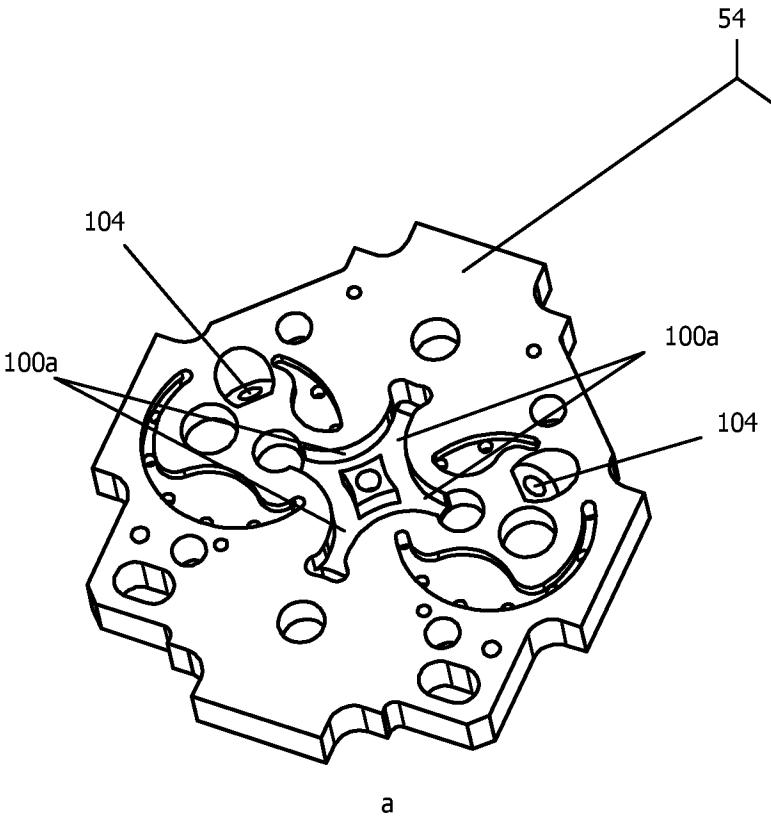

Between the cylinder block 81 and the valve top block 56, a valve seat plate 54 is arranged. This valve seat plate 54 enables the fluid transfer from the main cylinders I, III; II, IV to the auxiliary cylinders V, VII; VI, VIII of the same engine side R, L. FIG. 8 a and b shows both sides of the valve seat plate 54. A valve seat plate 54 is provided on each engine side R, L. Each valve seat plate 54 interface two main cylinders and two auxiliary cylinders V, VII; VI, VIII. For the main cylinders I, III; II, IV, the valve seat plate 54 provides a suction valve seat 101, a discharge valve seat 102 and a spark plug seat 104. For the auxiliary cylinders V, VII; VI, VIII, the valve seat plate 54 provides a fluid transfer channel **100*a* and an exhaust valve seat 103. Said fluid transfer channel 100*a* is interconnecting both auxiliary cylinders V, VII; VI, VIII with each other and with both main cylinders I, III; II, IV of the same engine side R, L. The fluid transfer channel 100*a* is a groove machined into the backside of the valve seat plate 54, sealed off by a metal gasket 55. The communication between the transfer channel 100*a* and the main cylinders I, III; II, IV are controlled by the discharge valves 32, whilst the communication between the transfer channel 100*a* and the auxiliary cylinders V, VII; VI, VIII are permanently open through a transfer inlet (100*b***).

Once the first expansion stage is completed in a first main cylinder I, III; II, IV, its discharge valve 32 opens. At this point, the main piston 7 of said main cylinder is at its BDC, and the auxiliary pistons 8 of the same engine side R, L are at their TDC. Exhaust gas is transferred from the main cylinder I, III; II, IV to the auxiliary cylinders V, VII; VI, VIII via the transfer channel **100*a*. The second expansion stage takes place inside the outer space of the auxiliary cylinders V, VII; VI, VIII. The second expansion stage is completed when the auxiliary pistons 8 reach their BDC. At that point, the discharge valve 32 of the main cylinder I, III; II, IV closes, and the exhaust valves 33 of the auxiliary cylinders V, VII; VI, VIII open. Exhaust gas escapes through the exhaust valves 33 of the auxiliary cylinders V, VII; VI, VIII, into the exhaust manifold 65. A first part of said exhaust manifold 65 being included in the valve top block 56. When the auxiliary pistons 8 reach their TDC again, all exhaust has escaped the auxiliary cylinders V, VII; VI, VIII and the exhaust valves 33 close. The auxiliary cylinders V, VII; VI, VIII will then receive a new pressurized exhaust gas from a second main cylinder I, III; II, IV of the same engine side R, L. The second expansion stage drives the first compression stage and powers the crankshaft 1**.

The cylinder bottom plate 52 has apertures for the main piston rods 5 and the auxiliary piston rods 4 to pass through. In the areas of the cylinder bottom plate 52 interfacing the main cylinders I, III; II, IV, additional apertures are provided for the passage of air.

TABLE 1

| the steps of a complete four stroke cycle | | | | |
|---|---|---|---|---|
| Stroke | 1 | 2 | 3 | 4 |
| Crankshaft rotation | 0/720° | 180° | 360° | 540° |
| Camshaft rotation | 0/360° | 90° | 180° | 270° |

TABLE 1-continued

| the steps of a complete four stroke cycle | | | | |
|---|---|---|---|---|
| Stroke | 1 | 2 | 3 | 4 |
| Main cylinder I (right engine side) | (intake) Main piston 7 at top dead centre, suction valve 31 opens, discharge vale 32 closes. | (compression) Main piston 7 at bottom dead centre, suction valve 31 closes, discharge valve 32 closed. | (power) Main piston 7 at top dead centre, charge ignited, both valves 31, 32 closed. | (exhaust) Main piston 7 at bottom dead centre, suction valve 31 closed, discharge valve 32 opens. |
| Main cylinder III (right engine side) | (power) Main piston 7 at top dead centre, charge ignited, both valves 31, 32 closed. | (exhaust) Main piston 7 at bottom dead centre, suction valve 31 closed, discharge valve 32 opens. | (intake) Main piston 7 at top dead centre, suction valve 31 opens, discharge valve 32 closes. | (compression) Main piston 7 at bottom dead centre, suction valve 31 closes, discharge valve 32 closed. |
| Auxiliary cylinders V and VII (right engine side) | Auxiliary pistons 8 at bottom dead centre, exhaust valve 33 opens, inlet check valve 69 open, outlet check valve 70 close. | Auxiliary pistons 8 at top dead centre, exhaust valve 33 closes, inlet check valve 69 closes, outlet check valve 70 opens. | Auxiliary pistons 8 at bottom dead centre, exhaust valve 33 opens, inlet check valve 69 opens, outlet check valve 70 closes. | Auxiliary pistons 8 at top dead centre, exhaust valve 33 closes, inlet check valve 69 closes, outlet check valve 70 opens. |
| Main cylinder II (left engine side) | (exhaust) Main piston 7 at bottom dead centre, suction valve 31 closed, discharge valve 32 opens. | (intake) Main piston 7 at top dead centre, suction valve 31 opens, discharge vale 32 closes. | (compression) Main piston 7 at bottom dead centre, suction valve 31 closes, discharge valve 32 closed. | (power) Main piston 7 at top dead centre, charge ignited, both valves 31, 32 closed. |
| Main cylinder IV (left engine side) | (compression) Main piston 7 at bottom dead centre, suction valve 31 closes, discharge valve 32 closed. | (power) Main piston 7 at top dead centre, charge ignited, both valves 31, 32 closed. | (exhaust) Main piston 7 at bottom dead centre, suction valve 31 closed, discharge valve 32 opens. | (intake) Main piston 7 at top dead centre, suction valve 31 opens, discharge valve 32 closes. |
| Auxiliary cylinders II and VIII (left engine side) | Auxiliary pistons 8 at top dead centre, exhaust valve 33 closes, inlet check valve 69 closes, outlet check valve 70 opens. | Auxiliary pistons 8 at bottom dead centre, exhaust valve 33 opens, inlet check valve 69 opens, outlet check valve 70 closes. | Auxiliary pistons 8 at top dead centre, exhaust valve 33 closes, inlet check valve 69 closes, outlet check valve 70 opens. | Auxiliary pistons 8 at bottom dead centre, exhaust valve 33 opens, inlet check valve 69 opens, outlet check valve 70 closes. |
| Elaboration | Remaining pressure in main cylinder II is transferred to auxiliary cylinders VI and VIII for the second expansion stage. Charge from auxiliary cylinders V and VII is transferred to main cylinder IV for the second compression stage. | Remaining pressure in main cylinder III is transferred to auxiliary cylinders V and VII for the second expansion stage. Charge from auxiliary cylinders II and VIII is transferred to main cylinder I for the second compression stage. | Remaining pressure in cylinder IV is transferred to auxiliary cylinders VI and VIII for the second expansion stage. Charge from auxiliary cylinders V and VII is transferred to main cylinder II for the second compression stage. | Remaining pressure in cylinder I is transferred to auxiliary cylinders V and VII for the second expansion stage. Charge from auxiliary cylinders II and VIII is transferred to main cylinder III for the second compression stage. |

Variable Valve Timing

Figure 9:
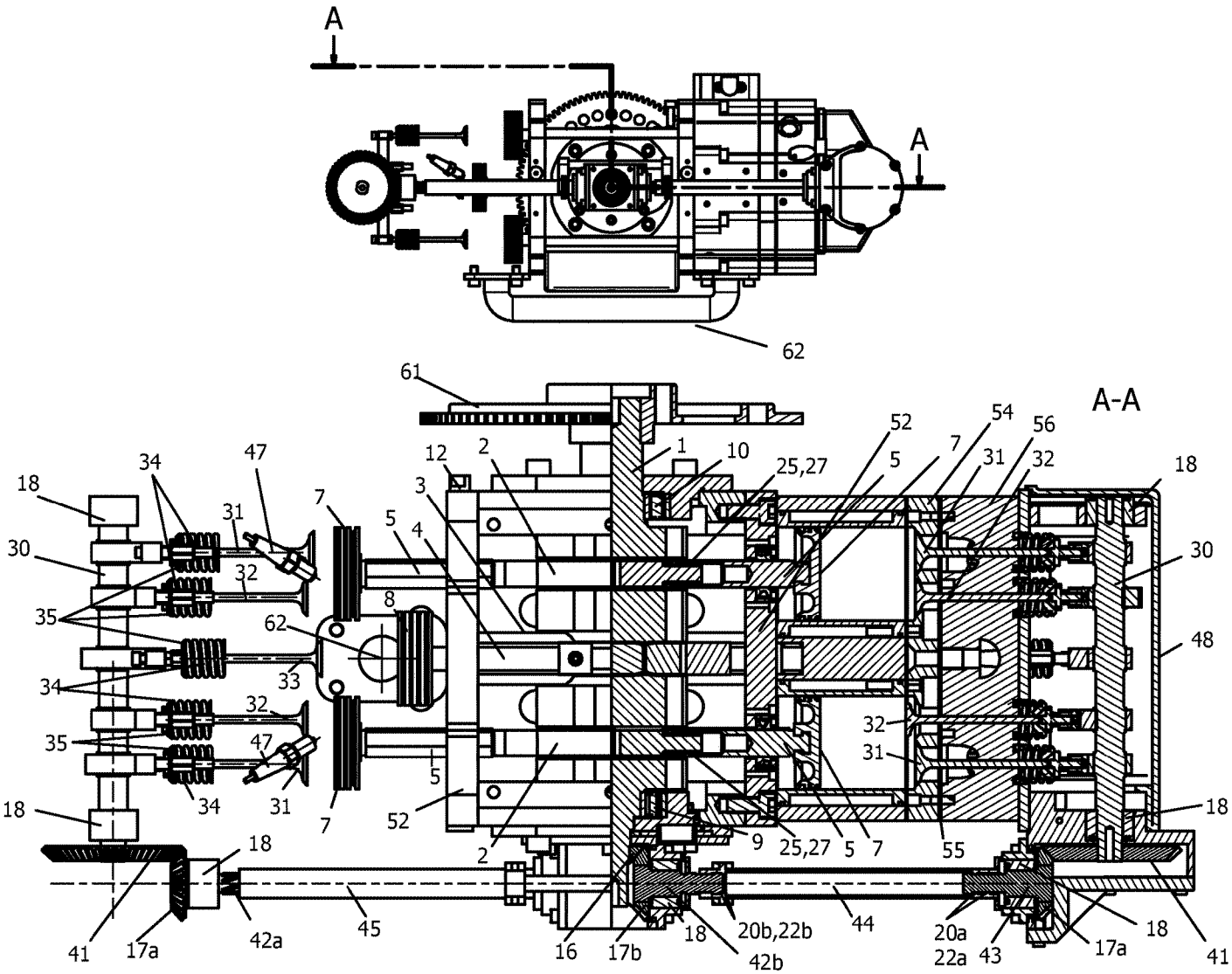
FIG. 9 shows a partial horizontal section view of the engine.
Figure 10:
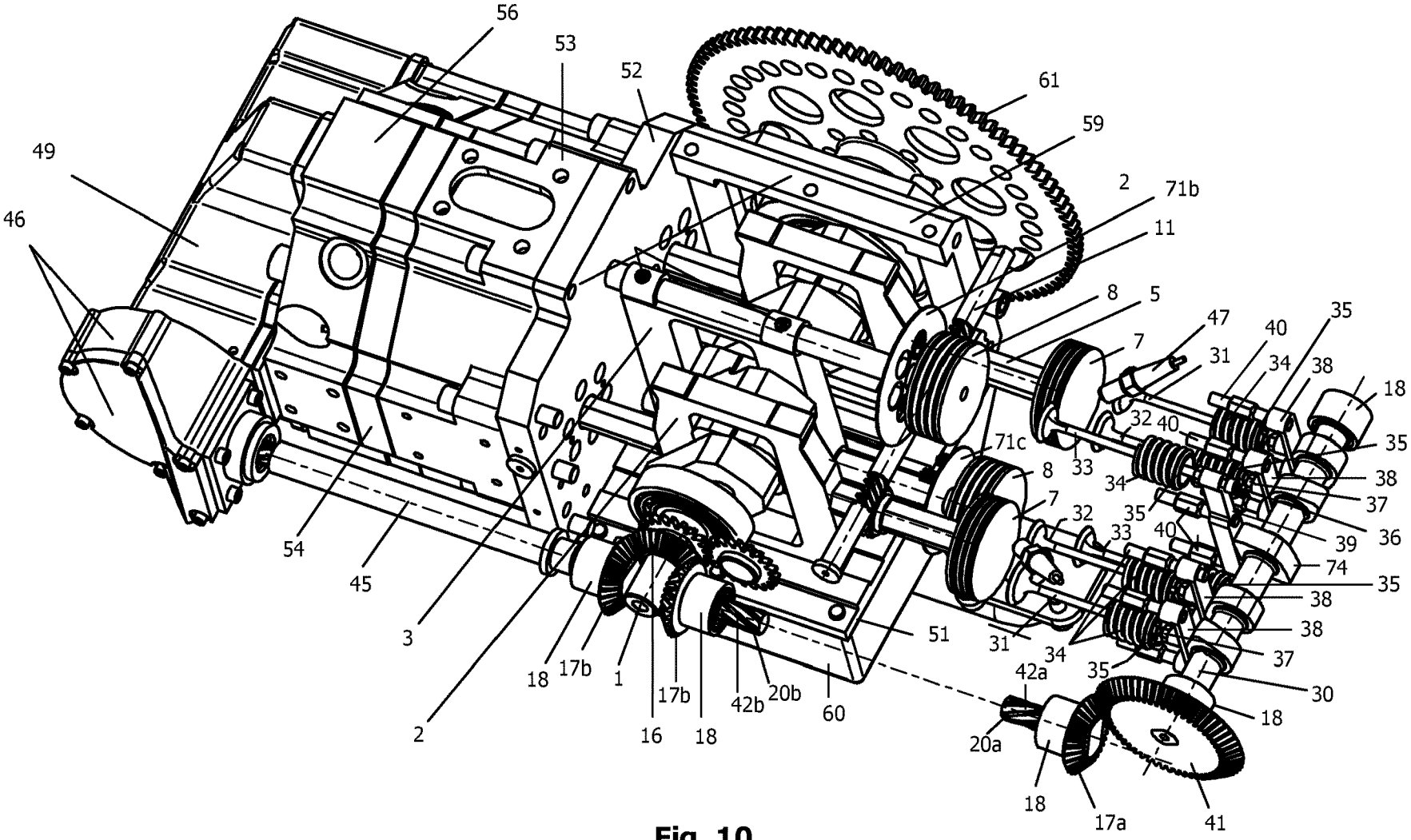
FIG. 10 shows an isometric view of the engine partly disassembled.

FIGS. 9 and 10 illustrate the mechanism enabling variable valve timing in the present invention. Rotational movement of the crankshaft 1 is transferred to the two camshafts 30 by means of interconnected gears 16, 17*a*, 17*b*, 41 and connection shafts 44, 45. By longitudinally adjusting a connection shaft 44, 45, the rotation of the corresponding camshaft 30 will be altered relative to the rotation of the crankshaft 1, i.e. the timing of the opening/closing of valves will change relative to the travel of the corresponding pistons.

FIG. 9 shows a horizontal section view of the right engine side R with all components present, and a top view of the left engine side L with most static components removed. The section view cuts through the centre of the main cylinders I, III and the centre of the connection shaft 44.

FIG. 10 shows an isometric view of the engine with the right engine side R having most static components removed, and a substantially complete left engine side L.

The gear ratio between the crankshaft 1 and the camshafts 30 is 2:1, i.e. the camshaft 30 will turn one revolution as the crankshaft 1 turns two revolutions. During two revolutions of the crankshaft 1, the main cylinders I, III; II, IV will performs a complete cycle (four strokes). The auxiliary cylinders V, VII; VI, VIII will perform a complete cycle as the crankshaft 1 turns one revolution. Because the suction valves 31, discharge valves 32 and exhaust valves 33 of the same engine side R, L are operated by the same camshaft 30, a 180° double cam 74, driving the exhaust valve 33, is positioned in the middle part of the camshaft 30.

In a first end of the crankshaft 1 a flywheel 61 is arranged, in a second end of the crankshaft 1 a crankshaft bevel gear 16 is arranged. In one end of the camshafts 30, oriented in the same direction as the second end of the crankshaft 1, a camshaft bevel gear 41 is arranged. A first connecting shaft bevel gear 17*a* in engagement with the crankshaft bevel gear 16, arranged in a 90° configuration, lines up with a second connecting shaft bevel gear 17*b* in engagement with the camshaft bevel gear 41, arranged in a 90° configuration. Said connecting shaft bevel gears 17*a*, 17*b* each have a centrally protruding, relatively short, spindle 42*a* 42*b* with external helical splines 20*a*, 20*b*. A first spindle 42*a* having left hand external helical splines 20*a*, and a second spindle 42*b* having right hand external helical splines 20*b*, or vice versa. Said spindles 42*a*, 42*b* are concentrically oriented and directed towards one another. A connection shaft 44, 45 connects the two connecting shaft bevel gears 17*a*, 17*b* of the same engine side R, L. The connecting shaft 44, 45 has internal helical splines 22*a*, 22*b* corresponding to those on the spindles 42*a*, 42*b*. Where a first end of the connection shaft 44, 45 has right hand internal helical splines 22*a*, and a second end of the connection shaft 44, 45 has left hand internal helical splines 22*b*, or vice versa. Lengthwise the connection shaft 44, 45 is shorter than the distance between the two connecting shaft bevel gears 17*a* 17*b*. The length of the connection shaft 44, 45 is long enough to always be engaged with both spindles 42*a* 42*b*, but short enough to allow some play in its longitudinal direction.

For simultaneous axial movement of the two connection shafts 44, 45, they are longitudinally interconnected. Adjustment of the connection shafts 44, 45 may be operated by hydraulic or electric linear actuators.

LIST OF REFERENCE NUMERALS

I, III; II, IV—main cylinders (right engine side; left engine side)
V, VII; VI, VIII—auxiliary cylinders (right engine side; left engine side)
P— plane
L— left engine side
R—right engine side
1—crank shaft
2—main yoke
3—auxiliary yoke
4—auxiliary piston rod
5—main piston rod
6—crank bearing half
7—main piston
8—auxiliary piston
9—front crank shaft bearing
10—aft crank shaft bearing
11—worm control shaft (right engine side)
12—worm control shaft (left engine side)
13—worm gear (right engine side)
14—worm gear (left engine side)
15—lubrication oil pump
16—bevel gear (crankshaft)
17*a*—first bevel gear (connecting shaft)
17*b*—second bevel gear (connecting shaft)
18—connection shaft bearing
20*a*—external helical splines (opposite 20*b*)
20*b*—external helical splines (opposite 20*a*)
22*a*—internal helical splines (opposite 22*b*)
22*b*—internal helical splines (opposite 22*a*)
23—sliding surface
25—stud
27—internal threads (main piston rod)
28—swivel coupling
30—camshaft
31—suction valve
32—discharge valve
33—exhaust valve
34—valve spring
35—spring washer
36—exhaust valve gap adjusting screw
37—main valves gap adjusting screw
38—main valves cam yoke
40—main valve yoke guide pin
41—bevel gear (camshaft)
42*a*—spindle (of 17*a*)
42*b*—spindle (of 17*b*)
44—connecting shaft (right engine side)
45—connecting shaft (left engine side)
46—cam gear housing
47—spark plug
48—right cam shaft housing
49—left cam shaft housing
50—upper guiding plate
51—lower guiding plate
52—cylinder bottom plate
53—cylinder block
54—valve seat plate
55—metal gasket
56—valve top block
59—crankshaft bearing plate
60—lubrication oil sump
61—flywheel
62—connection channel
63—throttle
65—exhaust manifold
66—fuel injection nozzle
67—auxiliary cylinder liner
68—main cylinder liner
69—check valve (inlet)
70—check valve (outlet)
71*a*—spring (for check valves)
71*b*—disc (for inlet check valves)
71*c*—disc (for outlet check valve)
72—pressure trap groove
74—double cam
77—guiding groove
81—cylinder block
100*a*—fluid transfer channel
100*b*—transfer inlet (auxiliary cylinder)
101—suction valve seat (main cylinder)
102—discharge valve seat (main cylinder)
103—exhaust valve seat (auxiliary cylinder)
104—spark plug seat
105—bore
110—main scotch yoke assembly
111—cooling water jacket
120—auxiliary scotch yoke assembly

The invention claimed is:

1. A boxer engine with two substantially mirror-symmetric engine sides including a crankshaft, the boxer engine comprising;

at least two main scotch yoke assemblies connected to the crankshaft, each of the at least two main scotch yoke assemblies each having one main piston (7) arranged inside one main cylinder of each engine side, and an auxiliary scotch yoke assembly connected to the crankshaft, the auxiliary scotch yoke assembly having a pair of auxiliary pistons arranged inside a pair of auxiliary cylinders of each engine side, wherein the main scotch yoke assemblies are arranged synchronized on the crankshaft and the auxiliary scotch yoke assembly is arranged 180° offset on the crankshaft, each auxiliary piston defining an outer space and an inner space within each auxiliary cylinder, the inner space facing the opposite engine side, wherein, said inner spaces of each auxiliary cylinder pair are in fluid communication and forming a compression chamber, said compression chamber comprises first and second check valves, wherein the auxiliary cylinder pair is adapted to suck in ambient air through the first check valve and compress and pump said air out through the second check valve (70) into a main cylinder (I, III; II, IV) of the opposite engine side, and said outer spaces of each auxiliary cylinder pair are in fluid communication and are receiving pressurized exhaust gas from a main cylinder of the same engine side.

2. A boxer engine according to claim 1, wherein the auxiliary pistons comprise circumferentially arranged pressure trap grooves.

3. A boxer engine according to claim 1, wherein each main scotch yoke assembly comprises a main piston rod with a polygonal cross-section, wherein each main piston rod:

at a first end has a swivel connection to the corresponding main piston;

at a second end has a threaded connection to a stud projecting from a corresponding main yoke; and is embraced by a longitudinally sliding worm gear.

4. A boxer engine according to claim 3, further comprising worm control shafts engaging the worm gears, said worm control shafts being adjusted by means of hydraulic or electric actuators.

5. A boxer engine according to claim 1, comprising two connecting shafts connecting the crankshaft and the camshafts operating the suction valves and the discharge valves of the main cylinders and the exhaust valves of the auxiliary cylinders, wherein each connecting shaft:

at a first end portion comprises first internal helical splines engaged with first external helical splines of a first protruding spindle of a first connecting shaft bevel gear, said first connecting shaft bevel gear being engaged with a cam shaft bevel gear connected to the camshaft;

at a second end portion comprises second internal helical splines engaged with second external helical splines of a second protruding spindle of a second connecting shaft bevel gear, said second connecting shaft bevel gear being engaged with a crankshaft gear connected to the crankshaft; and has a length which allows some longitudinal movement of the connecting shaft along the first and second protruding spindles, wherein the first external helical splines and the second external helical splines are opposite threaded, and the first internal helical splines and the second internal helical splines are opposite threaded.

6. A boxer engine according to claim 5, wherein the connecting shafts are longitudinally adjusted simultaneously by means of hydraulic or electric actuators.

7. A boxer engine according to claim 1, comprising a cam shaft with two cams for each main cylinder and a double cam for each auxiliary cylinder.

8. A boxer engine according to claim 1, wherein a valve seat plate, arranged between a valve top block and a cylinder block on each engine side, comprises:

two main cylinder suction valve seats;

two main cylinder discharge valve seats;

two auxiliary cylinder transfer inlets;

two auxiliary cylinder exhaust valve seats; and a fluid transfer channel, in fluid communication with both main cylinders discharge valve seats and both auxiliary cylinder transfer inlets.

9. A boxer engine according to claim 1, wherein the compression chambers and the main cylinders are connected by at least one connecting channel.

10. A boxer engine according to claim 9, wherein the at least one connecting channel is air cooled.

11. A boxer engine according to claim 1, wherein the weight of the at least one auxiliary yoke assembly is balanced with the weight of the at least two main yokes assemblies.

12. A boxer engine according to claim 1, wherein a cylinder bottom plate is sealing around reciprocating auxiliary piston rods connected to the auxilary pistons.

* * * * *